US010820665B1

(12) United States Patent
Baber

(10) Patent No.: US 10,820,665 B1
(45) Date of Patent: Nov. 3, 2020

(54) REMOVABLE BELT BUCKLE

(71) Applicant: Adin Hunter Baber, Manchester, MO (US)

(72) Inventor: Adin Hunter Baber, Manchester, MO (US)

( * ) Notice: Subject to any disclaimer, the term of this patent is extended or adjusted under 35 U.S.C. 154(b) by 0 days.

(21) Appl. No.: 16/577,167

(22) Filed: Sep. 20, 2019

Related U.S. Application Data

(60) Provisional application No. 62/735,518, filed on Sep. 24, 2018.

(51) Int. Cl.
*A44B 11/00* (2006.01)
*A44B 11/22* (2006.01)

(52) U.S. Cl.
CPC ..... *A44B 11/006* (2013.01); *A44B 11/22* (2013.01)

(58) Field of Classification Search
CPC ... A44B 11/006; A44B 11/22; Y10T 24/4026; Y10T 24/4028; Y10T 24/4035; Y10T 24/4053; Y10T 24/4079; Y10T 24/4081; Y10T 24/4736
See application file for complete search history.

(56) References Cited

U.S. PATENT DOCUMENTS 128,037 A * 6/1872 Hardennan ..... A44B 11/24 24/177
178,217 A * 5/1876 White ..... B68B 1/04 54/32
198,141 A * 12/1877 Moore ..... A44B 11/22 24/174
489,656 A 1/1893 Moores
1,429,139 A * 9/1922 Heberling ..... A44B 11/006 24/265 BC
6,851,160 B2 2/2005 Carver
7,520,031 B2 4/2009 Dahl
(Continued)

FOREIGN PATENT DOCUMENTS

DE 102012002370 8/2013

OTHER PUBLICATIONS

Eladichi Belt [online]. LA Times, Aug. 12, 2019, Retrieved from the Internet: <URL:https://www.latimes.com/business/a-xpm-2013-jan-27-la-fi-mo-belt-airport-security-snap-20130125-story.html>.
(Continued)

*Primary Examiner* — Robert Sandy
*Assistant Examiner* — Rowland Do
(74) *Attorney, Agent, or Firm* — Creativenture Law, LLC; Kevin C. Staed; Dennis J M Donahue, III

(57) ABSTRACT

The buckle is made up of a frame, clasp and restriction bar. A prong protrudes from the backside of the frame to engage a hole in one end of the belt strap and the clasp releaseably connects the buckle to the opposite end. The clasp has a pair of fingers at one end and a pair of arms that extend to a joint at the opposite end. When the buckle is connected to the belt, the clasp and restriction bar engage one another. The clasp is biased towards a reduced angle by the restriction bar with the fingers situated within a loop at the end of the belt. Conversely, when the clasp disengages the restriction bar, the fingers separate as the joint biases the arms apart and the space between the fingers widens allowing the fingers to slide out of the loop and separate the buckle from the belt.

20 Claims, 6 Drawing Sheets

(56) References Cited

U.S. PATENT DOCUMENTS

| | | | | |
|---|---|---|---|---|
| 9,149,090 | B1 | 10/2015 | Taylor | |
| 2009/0089979 | A1* | 4/2009 | Derrheim | A44B 11/006 24/163 R |

OTHER PUBLICATIONS

Booyah Belt [online]. Amazon, Aug. 12, 2019, Retrieved from the Internet: <URL:https://www.amazon.com/Booyah-Belt-Mens-Single-Large/dp/B00OT36SM8/ref=cm_cr_arp_d_product_top?ie=UTF8>.

Anchor (snap-on) Buckle [online]. Casanova, Aug. 12, 2019, Retrieved from the Internet: <URL:https://www.casanova1948.com/meet-casanova1948/brand-name-belt-types-and-designer-buckles-compatibility/>.

Flybelt [online]. Amazon, Aug. 12, 2019, Retrieved from the Internet: <URL:https://www.amazon.com/Flybelt-Carbon-Fiber-Embossed-Leather/dp/B010T7WET8>.

The Switch Buckle Belt by Everlane [online]. Youtube, Aug. 12, 2019, Retrieved from the Internet: <URL:https://www.youtube.com/watch?v=u0sbKNiB5Y>.

Slidebelts by Brig Taylor [online]. Slidebelts, Aug. 12, 2019, Retrieved from the Internet: <URL:https://www.slidebelts.com/products/top-grain-walnut-leather-belt?variant=10158828548&utm_medium=cpc&utm_source=google&utm_campaign=Google%20Shopping&gclid=EAlalQobChMIxeCqxcqN3QIViT9pCh07AApUEAQYBiABEgJAf_D_BwE>.

* cited by examiner

REMOVABLE BELT BUCKLE

CROSS-REFERENCE TO RELATED APPLICATIONS

This application claims priority from U.S. Provisional Patent Application No. 62/735,518 filed on Sep. 24, 2018.

STATEMENT REGARDING FEDERALLY SPONSORED RESEARCH

Not Applicable.

APPENDIX

Not Applicable.

BACKGROUND OF THE INVENTION

Field of the Invention

The present invention relates to belt buckles, and more particularly to belt buckles that releaseably connect to a belt strap with a separate clasp mechanism.

Related Art

Buckles have long been used to fasten two ends of a belt strap to one another. Two common types of buckles include the frame-style buckle and the plate-style buckle wherein the buckle is permanently connected to one end of the belt and removably fastens with the other end of the belt. In either these buckle type or the various other buckle types available in the prior art, the general principle is the same wherein the buckle is affixed to one end of the belt strap, the belt strap is secured around the waist of a wearer through multiple belt loops on the garment of the wearer, and the free distal end of the belt strap connects with the prong of the buckle. Therefore, the entire belt must be removed in order to remove the buckle, which can be an inconvenience to the wearer. Accordingly, it is desirable to provide a belt and buckle that does not necessarily need to be completely removed in situations where a person is going through a metal detector at a security checkpoint. Accordingly, there is a desire in the art to provide a belt buckle that can be easily removed from the belt without the wearer necessarily removing the belt strap from around their waist.

In a traditional frame-and-prong buckle, the frame connects to the proximal end of the belt strap with a prong attaching to one end of the frame and extending away from the wearer through a hole in the belt strap, where it anchors against the opposite side of the frame. In comparison, traditional plate-style buckles include a belt plate that is a substantially planar surface, such as with the Snap-On buckle described by Casanova® and shown in FIG. 1A in the prior art drawings. In operation the front face of the plate typically has a decorated surface and the back face of the plate has a hook or prong that fits within a hole in the distal free end of the belt when the belt is fastened.

Along with multiple buckle types in the prior art that fasten in various ways, there are multiple known ways to connect the buckles to belt straps. Some of the most common mechanisms for attaching a buckle to the end of a belt strap include providing a loop in the proximal end of the belt, screws, a chape, and snaps. When a loop is provided, the proximal end of the belt is looped through a portion of the buckle and is then sewn closed. Similarly, the loop can be secured with snaps or other fasteners rather than being permanently sewn. However, the buckle may not be detached without damaging the belt or may include a release mechanism on the proximal end of the strap, such as in the Switch Buckle™ belt shown in FIG. 1B in the prior art where the proximal end of the belt has releasable fasteners that unsnap and disengaged the belt form the buckle.

Other variations of buckles that permanently attach to the proximal end of the belt strap include a screw attachment where the buckle has a chape that is attached to the proximal end of the belt. The chape has holes where screws pass through and pierce the belt. Of course, the screws may be removed to disconnect the buckle from the belt but this process requires a screwdriver with a very small head and repeated detachment and reattachment will cause permanent damage to the belt. Similarly, other buckles may have a chape that attaches to the proximal end of the belt via a toothed mechanism. When closed, the teeth will pierce the belt and opening the teeth mechanism to remove the buckle requires a small pry-bar and repeated detachment and reattachment will cause permanent damage to the belt.

In comparison, buckles exist that releaseably attach to the proximal end of the belt and which can be quickly detached without additional tools. For example and as mentioned above, snaps can be used to attach the buckle to the proximal end of the belt where the proximal end of the belt is looped through the buckle, and then closed. The attachment mechanism is therefore attached to the belt, not the buckle. Further, these snaps are generally metal and a wearer cannot wear them while going through a security area.

Other examples of removable belt buckles include US Pat. No. 489,656 and U.S. Pat. No. 7,520,031 which describe buckles with a post that engage holes at both ends of the strap. However, these buckles necessarily require a hole at both ends of the belt strap and cannot readily be attached to the proximal end of the belt for an extended period of time. Another example of a removable belt includes the Flybelt™ which particularly requires a separate attachment mechanism on the proximal end of the belt that engages with the buckle, as shown in FIG. 1C.

Accordingly, the removable buckles in the prior art fail to provide a simple mechanism within the buckle itself that allows for a quick and easy removal. Accordingly, there remains a need in the art to provide an improved buckle that provides a clasp to connect the proximal end of the belt to the buckle.

SUMMARY OF THE INVENTION

The invention described herein is a removable belt buckle that can quickly be disconnected from a belt, preferably made of leather, and subsequently reconnected without necessarily removing the belt from the waist of the wearer. It is a particular aspect of the invention to allow for the buckle to quickly be removed prior to a wearer walking through a metal detector, for example at an airport or courthouse, without the wearer having to necessarily remove their entire belt. Accordingly, the belt strap preferably has no metal pieces or fasteners wherein the clasping mechanism, which allows for the quick removal of the buckle, is solely housed within the buckle rather than on the proximal end of the belt strap.

The buckle is generally made up of a frame, a clasp operatively connecting the frame to the belt and a restriction bar. A prong extends outwardly from the back face of the frame to engage a hole in the distal end of the belt strap and the restriction bar is situated on the opposite end of the back face of the frame from the prong. The clasp has a pair of fingers at one end and a corresponding pair of arms that extend to a joint at the opposite end of the clasp. When the buckle is connected to the belt, the fingers are positioned within a loop in the proximal end of the belt strap and the joint on the opposite end of the clasp from the fingers engages the bottom portion of the prong or a separate catch proximate thereto. Accordingly, the joint engages the catch that is either integrated with the prong of the buckle or separated from the prong and positioned between the prong and the restriction bar. To fasten the belt, the end of the prong is inserted into the hole on the free end of the belt and the buckle thereby connects the ends of the belt together.

In operation, the restriction bar restricts the movement of the arms and fingers of the clasp. The clasp arms pivot at the joint between a reduced angle when the clasp and restriction bar are actuated and an expanded angle when the clasp and restriction bar are unactuated. The joint continuously biases the pair of arms towards the expanded angle but when the clasp and restriction bar are in the actuated configuration, the distal ends of the arms abut the standoffs of the restriction bar and the arms are thereby prevented from expanding beyond the reduced angle. Conversely, when the clasp and restriction bar are in the unactuated configuration, clearance is provided between the distal ends of the arms of the clasp and the restriction bar and the joint biases the arms apart. Subsequently, the space between the fingers widens and the buckle can be disengaged from the loop at the end of the belt where the fingers can slide out of the loop.

In one buckle embodiment, the restriction bar is fixedly attached to the back face of the frame by the standoffs and the clasp slides through the opening between the frame and the restriction bar. When engaged, the joint is proximate to the opposite end of the frame from the restriction bar and the ends of the arms opposite from the joint abut the standoffs. Conversely, when unactuated, the joint is moved towards the restriction bar and the distal ends of the arms disengage the standoffs, allowing the joint to bias the arms of the clasp towards the expanded angle and subsequently move the fingers away from one another.

In an alternative buckle embodiment, the restriction bar slidingly connects to the back face of the frame within a pair of longitudinal recesses. When actuated with the clasp, the restriction bar is slid towards the end of the frame on the opposite end as the prong and the standoffs engage the distal ends of the arms, biasing the arms to the reduced angle and moving the fingers together. Conversely, when unactuated, the restriction bar is slid towards the prong where the distal end of the arms disengage the restriction bar and the arms can expand.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1C:
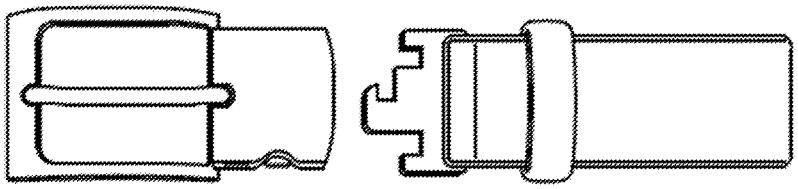
FIG. 1C (Prior Art)
FIGS. 1A-1C depict belt buckles in the prior art.
Figure 1B:
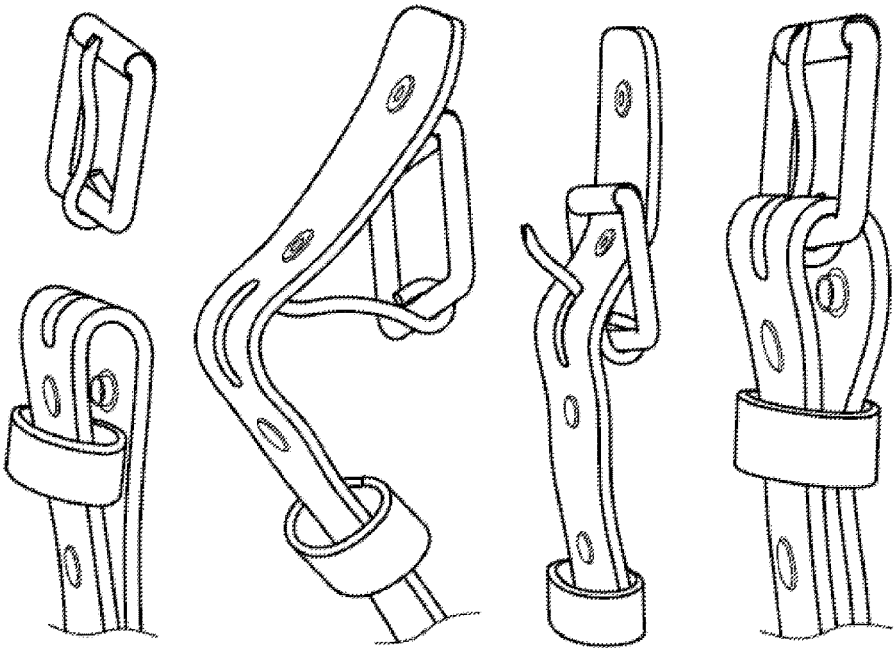
FIG. 1B (Prior Art)

The following description of the preferred embodiment(s) is merely exemplary in nature and is in no way intended to limit the invention, its application, or uses.

The removable belt buckle consists of a plate buckle that is used to connect the opposite ends of a belt strap while providing a clasp mechanism to quickly disconnect the buckle from the belt without the wearer necessarily removing the belt. As with belts in the prior art, the belt described herein has a free distal end with one or more holes for fastening the belt with one end of the buckle and a proximal end with a loop that removably attaches to the other end of the buckle. In traditional belt and buckle combinations, the proximal end of the belt is permanently attached to the buckle. To secure the belt around the waist of a wearer, the distal free end has a series of holes that secure within a prong on the back face of the frame of the buckle, as with other belts and buckles in the prior art. However, the innovative buckle described herein has a clasp mechanism that removably connects to the buckle to the loop in the proximal end of the belt. The clasp allows the proximal end of the belt to be connected and disconnected to the buckle in a repeated manner that does not bring harm to the loop in the end of the belt nor necessarily requires the belt strap to be removed from the waist of the wearer.

To provide a simpler belt buckle, the attachment mechanism is contained within the buckle with a clasp that engages a loop in the proximal end of the belt. Accordingly, the proximal end of the belt does not have any mechanical attachment mechanism and preferably has a sewn loop 108, such as shown in FIG. 7. It will be appreciated that the loop can also be formed with other fasteners, including snaps and adhesives. The purpose of this mechanism is to allow the buckle to be easily disconnected and subsequently reconnected while the person is wearing the belt. In addition, the buckle design focuses on making the mechanism rely on simple and durable mechanisms. Accordingly, the belt strap itself does not necessarily require metal parts or complex attachment means to connect the proximal end to the buckle, thus allowing the belt to be worn through security areas when the buckle has been removed.

The belt used with the removable buckle described herein is generally a belt strap with a free distal end and a proximal end that connects with the buckle. As with known belts, the strap is designed to encircle the waist of the wearer and pass through one or more belt loops in order to hold up the wearer's trousers or shorts. As particularly shown in FIG. 7D, the proximal end of the belt that connects to the clasp mechanism has a loop. Conversely, the free distal end of the belt has one or more holes into which the prong protrudes in order to secure the belt at varying lengths.

The removable belt buckle 10 particularly includes a frame 12, a restriction bar 14, a clasp 16 and prong 18 that collectively operate to connect the buckle to both the proximal end 102*a* and distal end 102*b* of a belt 100. The frame includes side edges 32 and ends 34 with a front face 30*b* that faces away from the wearer and back face 30*a* that faces towards the waist of the wearer. The frame itself preferably has a curvature, as depicted in FIGS. 2-4 and 7, but may also be a substantially planar frame with straight faces as depicted in FIG. 6. Further, it will be appreciated that the frame may also take other various shapes rather than the rectangular shape shown in the Figures and described herein. For example, buckle frames commonly come in oval or square shapes or may have an irregular shape. Accordingly, the clasp and restriction bar described herein can be combined with various buckle frames regardless of the particular shape of the frame and still function as a removable belt buckle.

Figure 1A:
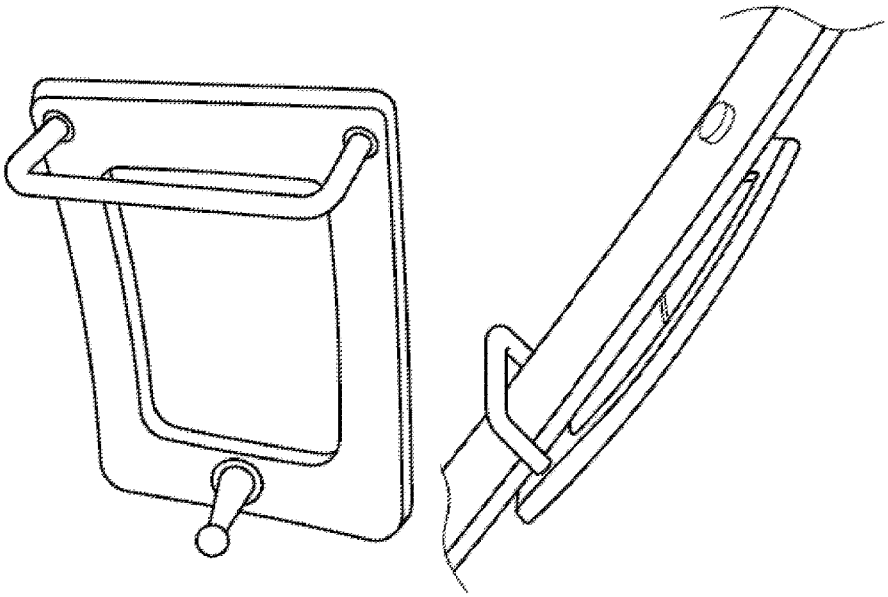
FIG. 1A (Prior Art)

As with other buckles in the prior art, the buckle described herein is designed to temporarily fasten two ends of a belt strap together and support the garment of a wearer. The buckle includes a traditional prong protruding a prong length 36 from the back face of the frame which is illustrated in FIGS. 2-4, 6 and 7 as well as in prior art FIG. 1A. To fasten the belt, the wearer engages the prong with one of the belt holes 104 in the distal end of the belt as shown in FIG. 7D. Conversely, to remove the belt the wearer merely needs to disengage the prong from the hole in the distal end of the belt. As with other belts, the wearer can select the preferred length wherein the free distal end of the belt has a series of holes that engage with the prong. Accordingly, the prong sits within one of the holes in the end of the belt and the belt strap is thereby secured.

Figure 7A:
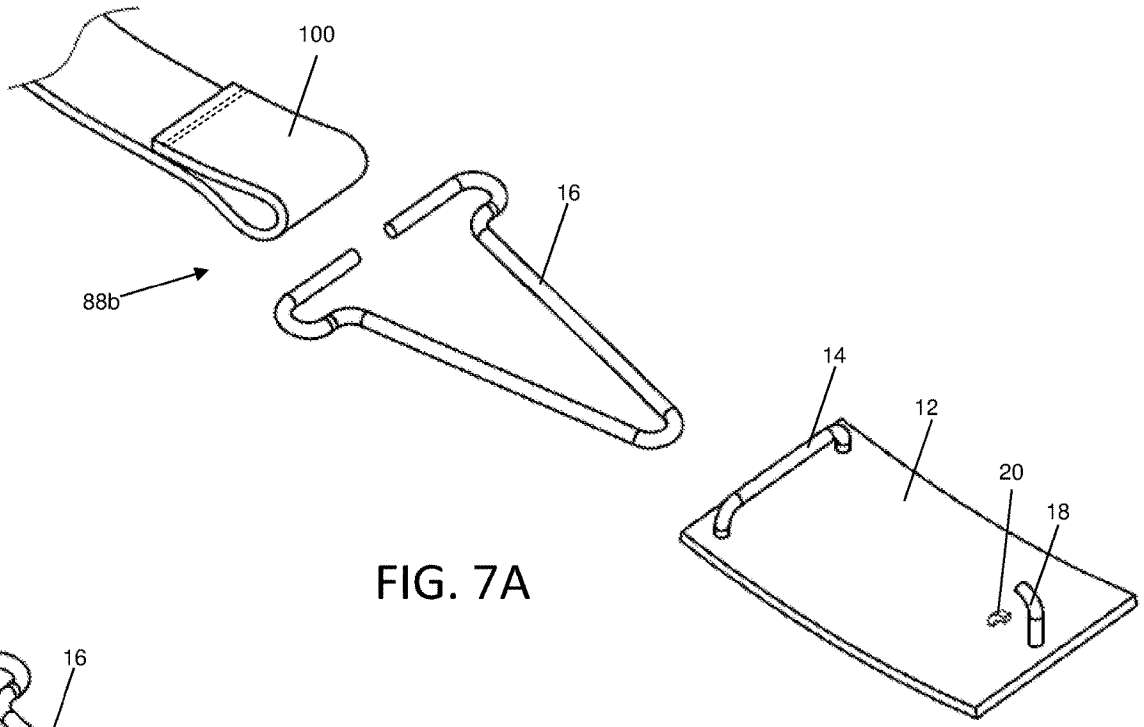
FIGS. 7A-7D illustrate the buckle in operation according to the invention described herein.
Figure 7B:
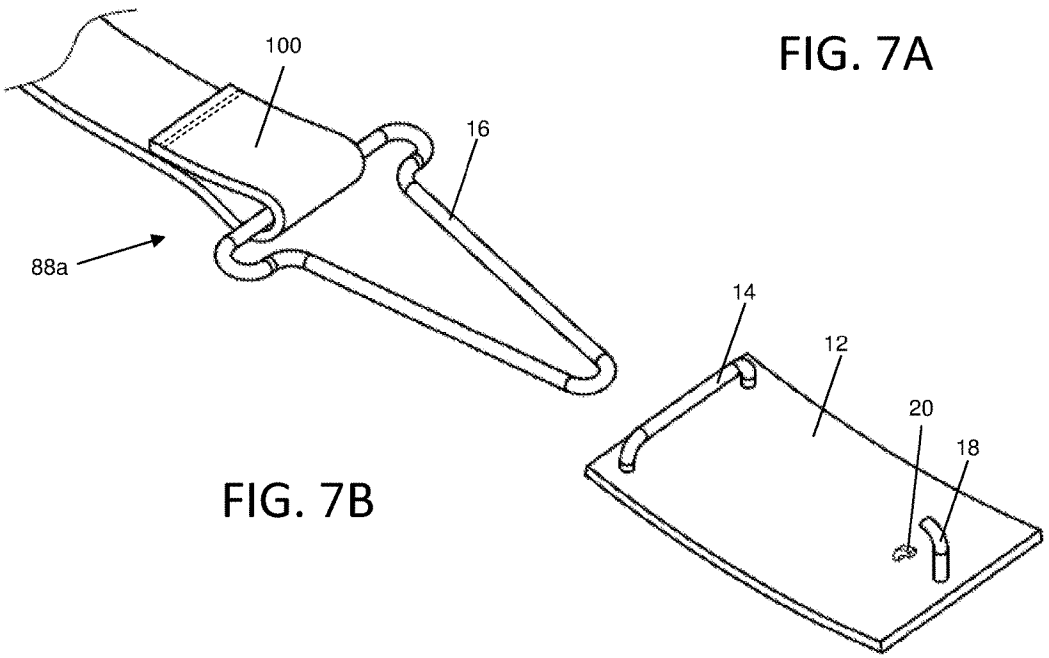
Figure 7C:
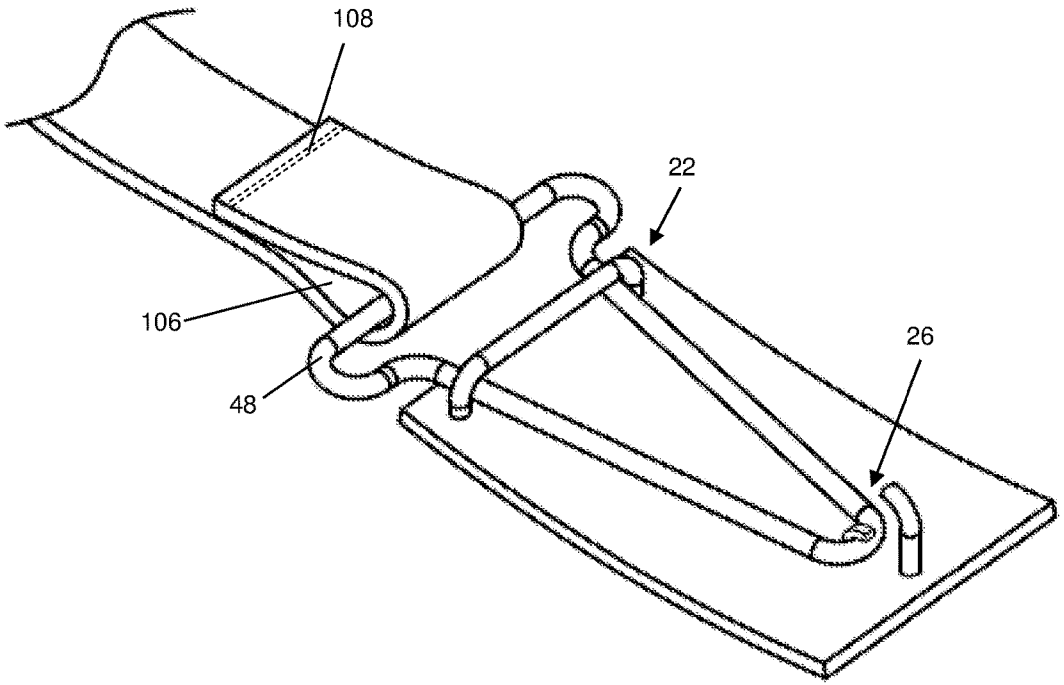

The inventive buckle described herein further includes a clasp which releaseably connects to a loop 106 in the proximal end of the belt on the opposite end of the buckle frame from the prong, such as shown in FIG. 7C. Accordingly, the wearer can disengage both the prong and the clasp from the respective distal and proximal ends of the belt and thereby detach the buckle from the belt all together, as depicted in FIG. 7A. Further, the clasp mechanism is designed so that it can quickly be unlocked and the buckle can be disconnected from the belt strap without tools or removing the belt strap from around the waist of the wearer. Similarly, the clasp allows the buckle to be quickly reconnected to the belt strap, for example when a wearer needs to briefly remove the buckle to pass through a metal detector and then reattach the buckle once the screening is complete.

The clasp includes a pair of arms 46 extending from a joint 44 connecting the proximal end of the respective arms 50*a* to a pair of fingers 48 at the distal end of the arms 50*b*. As illustrated in FIG. 5, the joint and fingers are separated by the length 54 of the arms. The clasp is generally situated proximate to the back face of the frame with the joint positioned near one end of the frame 34*a* and the fingers positioned near the opposite of the frame 34*b*. Further, the fingers extend a finger length 56 from the distal end of the arms and releaseably engage the loop in the end of the belt as shown in FIG. 7B.

To attach the clasp to the buckle, a restriction bar laterally extends between the edges of the frame and provides an opening 42 adjacent to the back face of the frame. In operation, the clasp and restriction bar move relative to one another between an actuated configuration 22 and an unactuated configuration 24 with the angle between the pair of arms reducing as the clasp and restriction bar move into the actuated configuration. In the preferred embodiment, the clasp slides through the opening into the actuated configuration but other embodiments may include a fixed clasp wherein the restriction bar slides along the back face of the frame, as further described herein. The restriction bar includes a center section 40 between a pair of standoffs 38 that connect to the back face of the frame. The proximate ends 64*a* of the standoffs are respectively attached near opposite side edges 32*a* & 32*b* of the frame and extend a standoff length 52 to their respective distal ends 64*b* that are attached to opposite ends of the center section. Thus, the center section is spaced from the back face of the frame by the length of the standoffs and the opening is formed between the center section of the restriction bar and the back face of the frame.

In the preferred method of operation shown in FIG. 2, the arms of the clasp slide through the opening between the actuated configuration with the distal end of the arms engaging the standoffs of the restriction bar and the unactuated configuration with the distal ends of the arms being disengaged from the standoffs. Although the buckle can be disassembled and the clasp can be completely removed from the frame in some embodiments, during operation the fingers are situated on one side of the restriction bar and the joint is situated on the opposite side of the restriction bar with the arms of the clasp extending through the opening and being held substantially near the back face of the frame.

Figure 2B:
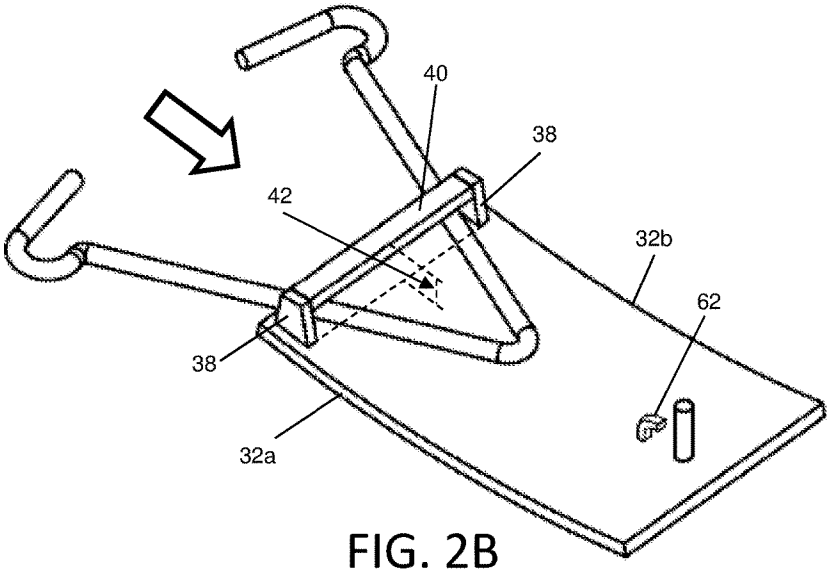
FIGS. 2A-2D depict a buckle with a sliding clasp, fixed restriction bar and catch according to the invention described herein.
Figure 2D:
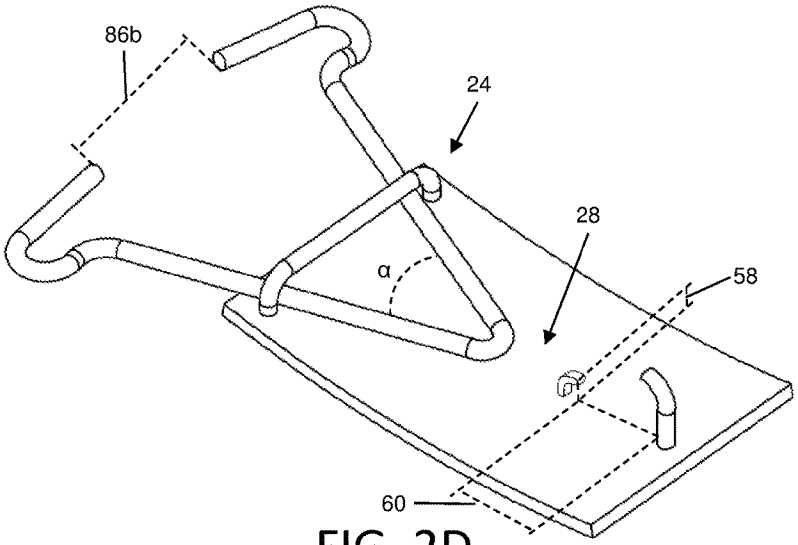

To engage and disengage the clasp from the proximal end of the belt, the pair of arms pivot between an expanded angle ($\alpha$) and a reduced angle ($\beta$) ($\alpha>\beta$) wherein the joint biases the arms apart and causes the distance 86*ba* between the fingers at the end of each arm to widen when the clasp is in the unactuated configuration and the standoffs are not biasing the clasp towards the reduced angle. Conversely, as the angle between the arms reduces, the distance 86*a* between the pair of fingers also reduces where the restriction bar engages the distal ends of the pair of arms and biases the arms towards the reduced angle. As illustrated in FIGS. 2C and 2D, the pair of fingers are more proximate to the opening than the joint in the actuated configuration and the joint is more proximate to the opening than the pair of fingers in the unactuated configuration.

When the clasp and restriction bar are in the actuated configuration, the distal ends of the arms of the clasp engage the respective standoffs and the restriction bar biases the arms together towards the reduced angle, as shown in FIGS. 2A, 2C, 3A and 4A. When the pair of arms engage the standoffs of the restriction bar, the distance between the fingers is reduced and the clasp can securely connect the buckle to loop in the proximal end of the belt. Conversely, when the clasp is in the unactuated configuration, shown in FIGS. 2B, 2D, 3B and 4B, the joint biases the arms apart towards the expanded angle and the distance between the fingers widens allowing the clasp to be disconnected from the loop in the end belt. Thus, the loop in the proximal end of the belt engages the fingers of the clasp in an attached position 88*a* and can subsequently be detached 88*b* when the fingers are biased apart.

As noted above, the standoffs of the restriction bar engage the distal ends of the arms in the actuated configuration and are separated from the distal end of the arms as the joint gets closer to the restriction bar in the unactuated configuration. Thus, the standoffs bias the arms of the clasp towards the reduced angle when the joint is positioned proximate to the prong and the fingers are proximate to the opening. In another aspect of the buckle described herein, the standoffs have a length that is less than the length of the prong so that the prong protrudes past the restriction bar, as shown in FIG.

7D. This length according to the preferred embodiment is approximately equal to one-half the length of the prong but it will be appreciated that the length of the standoffs may vary relative to the overall size of the buckle and belt.

In another aspect of the buckle described herein, the clasp is prevented from sliding through the opening and disengaging the restriction bar where the joint locks with one of the prong or a catch 20 in a locked orientation 26 and disengages the prong or catch in an unlocked orientation 28. Regardless of whether a catch is provided or if the joint simply engages a portion of the prong as explained below, at least one of the clasp and restriction bar move relative to one another between the actuated and unactuated configuration. Similarly, the clasp is prevented from moving between the actuated configuration and the unactuated configuration when the clasp is in the locked orientation but can freely move between the actuated configuration and the unactuated configuration when the clasp is unlocked.

In the preferred embodiment shown in FIG. 2, the frame includes a catch protruding a catch length 58 from the back face of the frame which is spaced a distance 60 from the prong at a location 62 between the restriction bar and the prong. Although the distance between the prong and catch is not intended to be limiting, the catch is more proximate to the prong than the restriction bar where the distance between the prong and the catch is less than twice the prong length. For example, the catch in FIGS. 2A and 2B is less than one prong length away from the prong. However, the catch in FIGS. 2B and 2C is greater than one prong length from the prong.

Figure 2A:
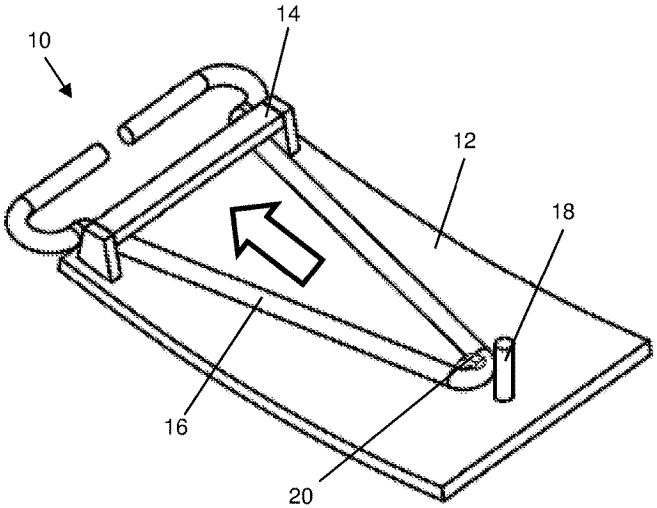
Figure 2C:
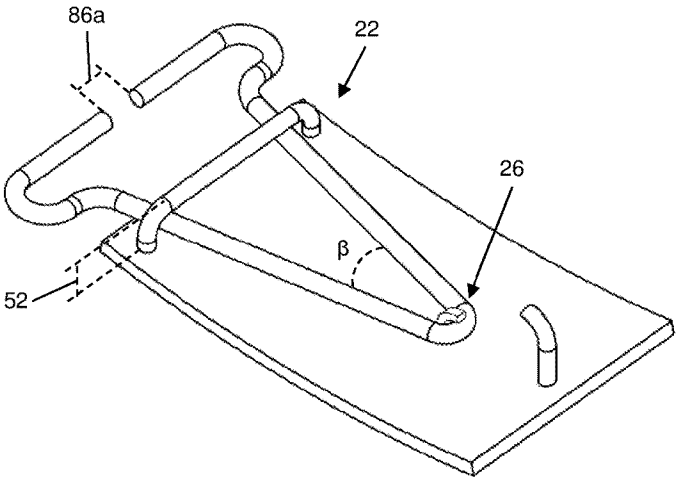

In operation the joint of the clasp engages the catch in the locked orientation as shown in FIG. 2A and the clasp is restricted from sliding through the opening between the actuated configuration and the unactuated configuration. Subsequently, the joint can be disengaged from the catch and the clasp is unlocked, as shown in FIG. 2B, allowing the clasp to freely slide between the actuated configuration and the unactuated configuration. When the joint is locked and the clasp is in the actuated configuration, the fingers come together such that clasp is secured to the loop in the proximal end of the belt. In addition, the catch length is less than the length of the prong so that the prong can readily engage the holes of the belt strap without interference from the clasp or catch when the wearer is fastening the belt.

In the alternative embodiment shown in FIG. 3, the clasp is comprised of a bracket 82 that protrudes a bracket length 84, which is less than the prong length and preferably less than the length of the standoffs, from the back face of the frame and fixedly holds the joint of the clasp. In this embodiment the clasp does not move and the restriction bar moves between actuated and unactuated configurations a sliding within recesses from a locked end 66*a* where the clasp and restriction bar are engaged to the unlocked end 66*b* where the clasp and restriction bar are disengaged. Accordingly, the restriction bar movably engages the back face of the frame through longitudinal recesses 68 and the clasp is fixed at the joint by the bracket. The restriction bar is attached to the frame wherein the proximal ends of one of the standoffs 38*a* is slidingly engaged with one of the recesses 68*a* and the other standoff 38*b* is slidingly engaged with the other recess 68*b*. As illustrated in FIG. 3, the recesses are respectively situated near opposite side edges of the frame and longitudinally extend a recess length 70 between the opposing ends of the frame. Although the recess length between the locked end and the unlocked end is not intended to be limiting, the length preferably traverses the midline 90 of the frame wherein the locked end is situated on one half of the frame proximate to the prong and bracket and the unlocked end is situated on the other half of the frame opposite from the prong and bracket.

Figure 3B:
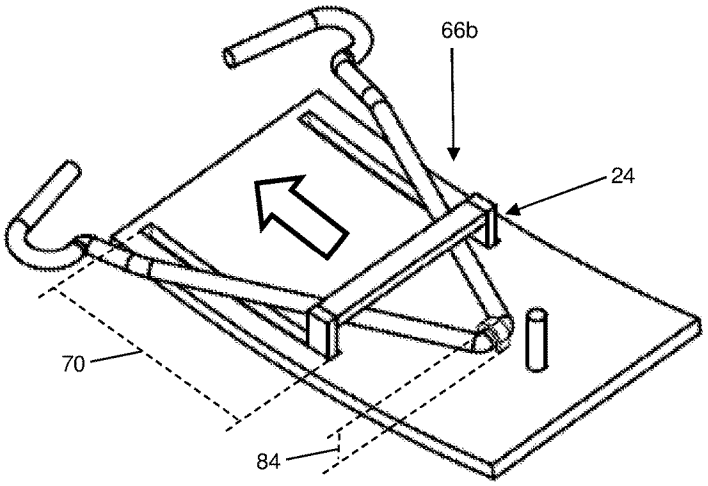
FIGS. 3A and 3B depict a buckle with a sliding restriction bar, fixed clasp and catch according to the invention described herein.
Figure 4B:
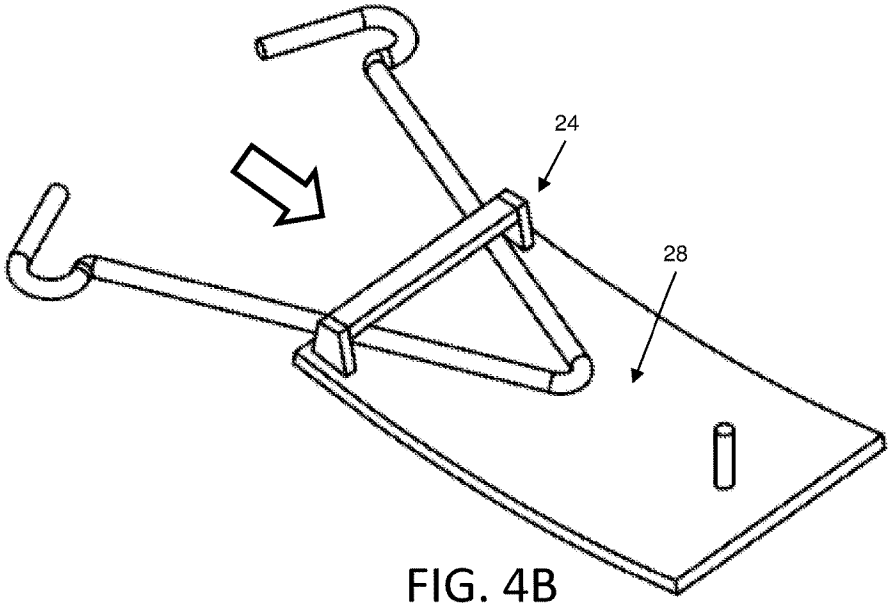
FIGS. 4A and 4B depict a buckle with a sliding clasp, fixed restriction bar and prong according to the invention described herein.
Figure 3A:
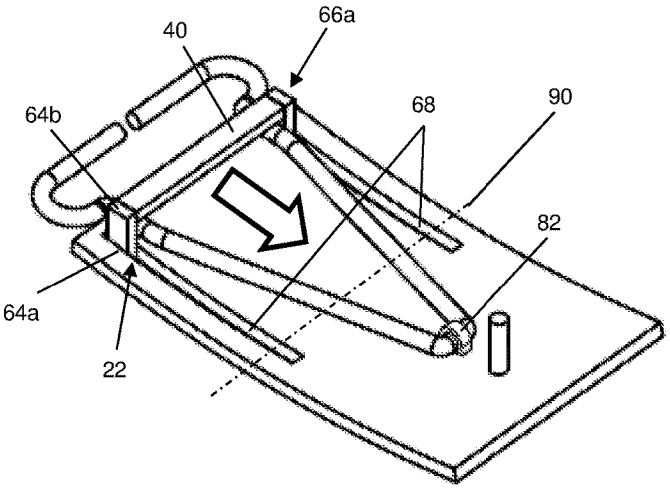
Figure 4A:
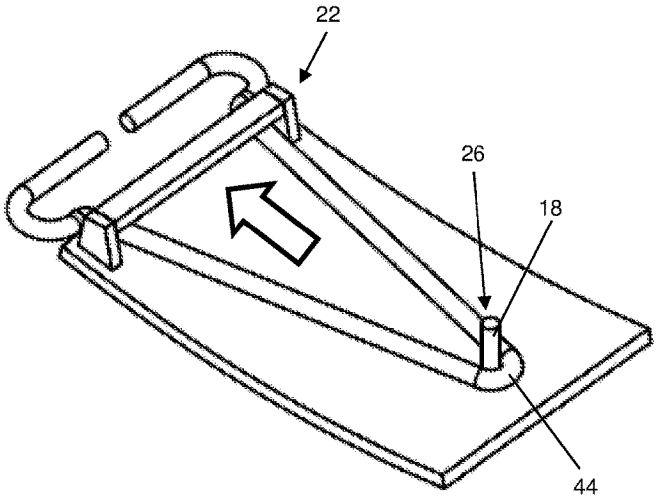

When the restriction bar is slid towards the locked end into the actuated configuration, such as shown in FIG. 3A, the distal end of the arms of the clasp engage the standoffs and the fingers of the clasp are moved together causing the fingers to lock within the loop in the proximal end of the belt. Conversely, when the restriction bar is slid towards the unlocked end and into the unactuated configuration, the clasp unlocks and the arms are biased apart as shown in FIG. 3B, thus allowing the proximal end of the belt to be removed from the fingers of the clasp. Thus, the method of operation does not change between the embodiments wherein the wearer can remove the buckle by either by sliding the clasp itself in the preferred embodiment or by sliding the restriction bar in the alternative embodiment which respectively adjust the angle between the pair of arms and distance between the fingers that engage the belt.

In another alternative embodiment shown in FIG. 4, the buckle and innovative clasp mechanism described herein operate without a catch wherein the joint of the clasp hooks over the prong in the locked orientation. Accordingly, the prong doubles as the catch with the clasp and restriction bar operating in the same manner as the preferred embodiment described above. In operation, the buckle can be attached to the belt strap by disengaging the joint of the clasp from the prong and actuating the clasp by sliding the clasp away from the prong through the opening. Subsequently, the fingers are biased apart and inserted into respective ends of the loop on the belt strap. The joint of the clasp can then be slid back through the opening and re-engage the prong in the locked orientation, securing the buckle. To remove the buckle from the belt the wearer need only disengage the joint of the clasp from the prong and slide the clasp to the unactuated configuration and allow the fingers to widen. Accordingly, the buckle can be removed from the belt strap without necessarily removing the belt from around the wearer's waist or using any additional tools.

Figure 5B:
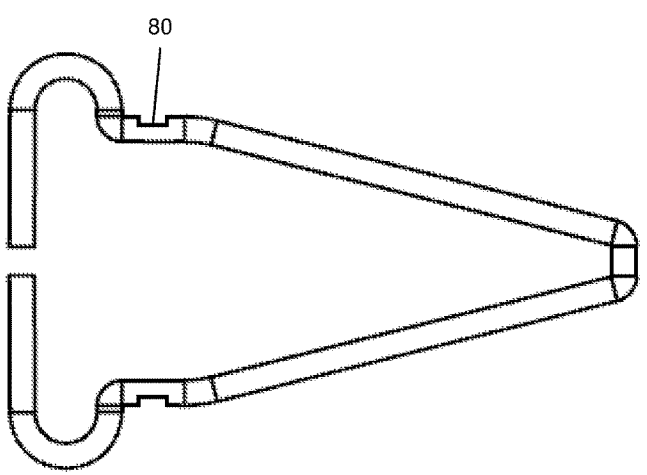
FIGS. 5A and 5B depict alternative clasp embodiments according to the invention described herein.
Figure 5A:
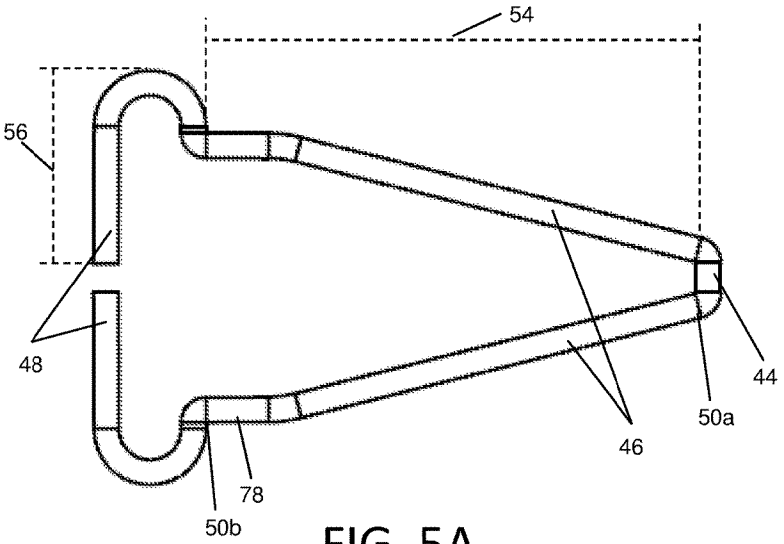

As shown in FIG. 5A, the clasp can have smooth sidewalls with a flat edge 78 at the distal end of the arm that rests against the standoffs of the restriction bar in the actuated configuration. In such an embodiment the frictional force between the standoffs and the arms of the clasp along with the pressure from the joint biasing the arms outwardly towards the expanded angle further lock the clasp in combination with the locking joint and catch. Alternatively, the clasp can have an improved locking system wherein a notch 80 is provided in the distal ends of the clasp arms, as shown in FIG. 5B, to provide a better connection between the clasp and standoffs. When a notch is provided, the standoffs nest within the respective notches in the arms in the actuated configuration and the clasp or restriction bar cannot be moved without first unlocking the joint from the catch and disengaging the standoffs from the arm notches.

In another aspect of the invention, the prong may include a top portion 72*a* that is intended to engage the hole in the distal end of the belt and a bottom portion 72*b* that engages the joint in the locked orientation. As shown in FIG. 6A, the top portion of the prong may have various shapes. Such shapes may include but are not limited to a straight prong 76*a*, a bulb prong 76*b*, and a curved prong 76*c*. The straight prong is a simple prong that is straight for the entire length. The prong will be inserted in one of the holes of the free end of the belt so that it can be worn. Alternatively a bulb prong may have a slight taper and a small round bulb on the end of the prong. The small indention combined with the ball causes the prong to better retain its grasp on the free end of the belt. Similarly, a curved prong has a small hook on the top portion of the prong. Preferably, the direction of the hook is opposite of the free end of the belt so as to more securely hold the free end of the belt. Using the hook causes the prong to better retain its grasp on the free end of the belt. It will be appreciated that the buckle described herein may use any of the above or various other types of prongs.

Figure 6B:
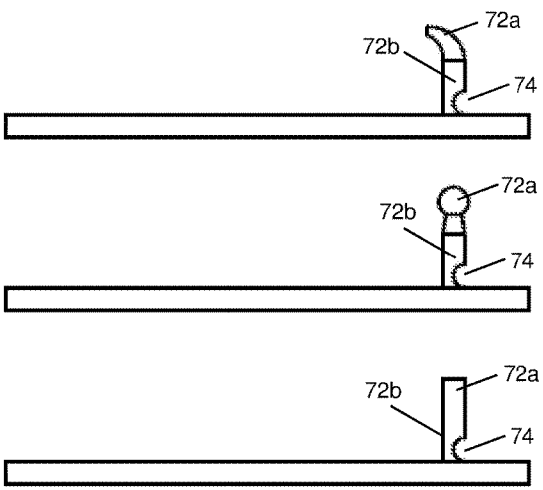
FIGS. 6A and 6B depict alternative prong embodiments according to the invention described herein.
Figure 6A:
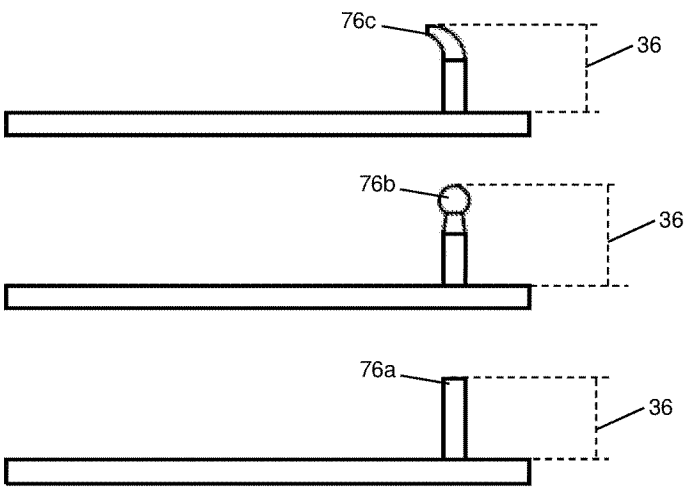
Figure 7D:
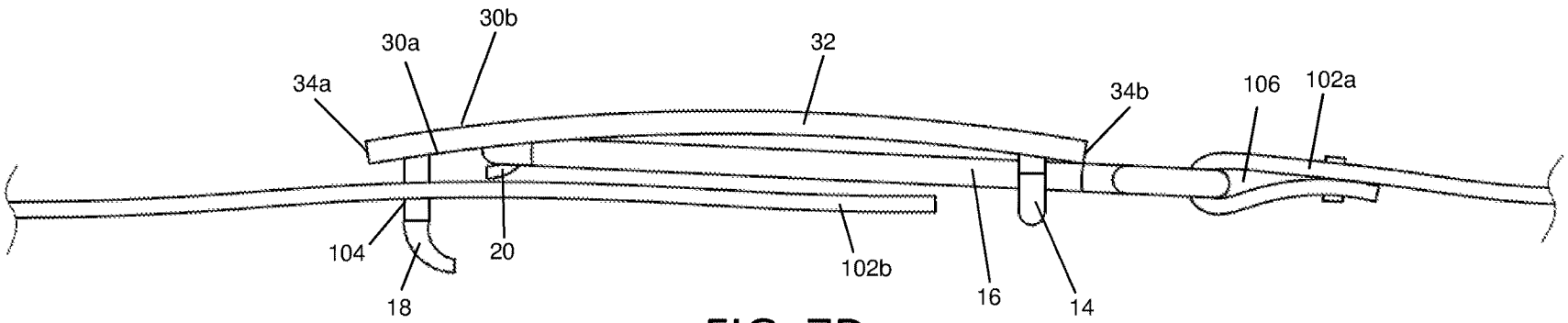

In addition to various shapes used in the top portion of the prong, a cutout section 74 may be used in the bottom portion of the prong as shown in FIG. 6B. Such a cutout section is particularly used in embodiments where the bottom portion of the prong doubles as the catch, such as explained above with regard to the embodiment depicted in FIG. 4. Alternatively, a cutout section may be used in the separate catch portion to more securely hold the joint according to the preferred embodiment depicted in FIG. 2. As shown in FIG. 6B, a cutout can be formed in the prong or catch to more securely hold the joint of the clasp. When notches in the arms of the clasp and cutouts in the prong or catch are used, the clasp is less likely to unintentionally become dislodged from the locked orientation and actuated configuration and thus the overall buckle is more secure.

Additionally, it is an aspect of the preferred embodiment to have a prong length that is greater than the height of the restriction bar. Accordingly, the prong can accommodate the joint of the clasp and still securely hold the distal end of the belt to the buckle. Alternatively, it will be appreciated that the length of the prong may be shorter than the height of the restriction bar, such as when the joint engages a separate catch as described herein. However, when a catch is used, such as in the preferred embodiment, the catch has a length that is less than The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A buckle for a belt, comprising:

a frame comprising a front face, a back face, a pair of side edges, a first end, a second end, and a prong, wherein the prong is connected to the back face proximate to the first end and extends a prong length away from the back face, and wherein the prong removably engages a hole in a distal end of the belt;

a restriction bar comprising a pair of standoffs and a center section, wherein the pair of standoffs respectively comprise a proximal standoff end and a distal standoff end separated by a standoff length, wherein the proximal standoff end of a first standoff engages the frame proximate to a first of the side edges, wherein the proximal standoff end of a second standoff engages the frame proximate to a second of the side edges, wherein the center section connects to the respective standoff distal ends and laterally extends between the pair of side edges, and wherein the pair of standoffs and the center section collectively define an opening adjacent to the back face of the frame; and a clasp comprising a joint, a pair of arms, and a pair of fingers, wherein the pair of arms extend an arm length from a proximal arm end respectively connected to the joint to a distal arm end respectively connected to the pair of fingers, wherein the clasp extends from the joint positioned proximate to the first end of the frame through the opening to the fingers positioned proximate to the second end of the frame, wherein the pair of fingers extend a finger length from the distal arm end and removably engage a loop in a proximal end of the belt, wherein the pair of arms pivot between an expanded angle in an unactuated configuration and a reduced angle in an actuated configuration, wherein the joint biases the pair of arms towards the expanded angle, wherein the restriction bar biases the pair of arms towards the reduced angle in the actuated configuration, wherein the pair of fingers are located distally from one another in the unactuated configuration, and wherein the pair of fingers are located proximally to one another in the actuated configuration.

2. The buckle of claim 1, wherein the clasp slides through the opening between the actuated configuration and the unactuated configuration, wherein the distal arm ends engage the restriction bar in the actuated configuration, wherein the distal arm ends disengage the restriction bar in the unactuated configuration, wherein the joint engages the prong in a locked orientation, wherein the clasp is restricted from sliding through the opening in the locked orientation, wherein the joint disengages the prong in an unlocked orientation, and wherein the clasp freely slides through the opening in the unlocked orientation.

3. The buckle of claim 2, wherein the prong further comprises a top portion and a bottom portion, wherein the top portion releasably engages the hole in the distal end of the belt, wherein the bottom portion further comprises a cutout, wherein the cutout is shaped to releasebly receive the joint in the locked orientation, and wherein the top portion of the prong is selected from the group consisting of a straight post, a bulb, and a curved post which engage the hole in the distal end of the belt.

4. The buckle of claim 1, wherein the standoff length is no greater than half the prong length.

5. The buckle of claim 1, wherein the pair of fingers are situated on a first side of the opening and the joint is situated on a second side of the opening, wherein pair of fingers are more proximate to the opening than the joint in the actuated configuration, wherein the joint is more proximate to the opening than the pair of fingers in the unactuated configuration, wherein the distal arm ends respectively abut the pair of standoffs in the actuated configuration and bias the pair of arms to the reduced angle, and wherein the pair of standoffs are separated from the distal arm ends in the unactuated configuration and the joint biases to the pair of arms the expanded angle.

6. The buckle of claim 5, wherein each of pair of arms further comprise a notch at the distal arm end, and wherein the pair of standoffs respectively nest within the notches in the actuated configuration.

7. The buckle of claim 1 further comprising a catch protruding a catch length from the back face of the frame, wherein the catch is positioned at a location between the prong and the restriction bar and is spaced a distance from the prong towards the second end of the frame, wherein the catch length is no greater than the standoff length, and wherein the distance is less than twice the prong length.

8. The buckle of claim 7, wherein the clasp slides through the opening between the actuated configuration and the unactuated configuration, wherein the distal arm ends engage the restriction bar in the actuated configuration, wherein the distal arm ends disengage the restriction bar in the unactuated configuration, wherein the joint releaseably engages the catch in a locked orientation, wherein the clasp is restricted from sliding translating through the opening in the locked orientation, wherein the joint disengages the catch in an unlocked orientation, and wherein the clasp freely slides through the opening in the unlocked orientation.

9. The buckle of claim 7, wherein the frame further comprises a pair of longitudinal recesses on the back face of the frame, wherein a first of the longitudinal recesses is situated proximate to the first of the side edges, wherein a second of the longitudinal recesses is situated proximate to the second of the side edges, wherein the proximal standoff end of the first standoff slidingly engages the first longitudinal recess, wherein the proximal standoff end of the second standoff slidingly engages the second longitudinal recess, and wherein the restriction bar slides along the pair of longitudinal recesses and engages the distal arm ends of the clasp in the actuated configuration and disengages the distal arm ends of the clasp in the unactuated configuration.

10. The buckle of claim 9, wherein the pair of longitudinal recesses respectively comprise a recess length between a locked end proximate to the second end of the frame and an unlocked end proximate to the catch, wherein the restriction bar is situated proximate to the locked end in the actuated configuration, and wherein the restriction bar is slid away from the locked end towards the unlocked end in the unactuated configuration.

11. The buckle of claim 9, wherein the catch is comprised of a bracket protruding a bracket length from the back face of the frame, and wherein the joint fixedly engages the bracket.

12. A buckle for a belt, comprising:

a frame comprising a front face, a back face, a pair of side edges, a first end, a second end, and a prong, wherein the prong is connected to the back face proximate to the first end and extends a prong length away from the back face, and wherein the prong removably engages a hole in a distal end of the belt;

a restriction bar comprising a pair of standoffs and a center section, wherein the pair of standoffs respectively comprise a proximal standoff end and a distal standoff end separated by a standoff length, wherein the proximal standoff end of a first standoff engages the frame proximate to a first of the side edges, wherein the proximal standoff end of a second standoff engages the frame proximate to a second of the side edges, wherein the center section connects to the respective standoff distal ends and laterally extends between the pair of side edges, and wherein the pair of standoffs and the center section collectively define an opening adjacent to the back face of the frame;

a clasp comprising a joint, a pair of arms, and a pair of fingers, wherein the clasp is situated proximate to the back face of the frame, wherein the pair of arms extend an arm length from a proximal arm end respectively connected to the joint through the opening to a distal arm end respectively connected to the pair of fingers, wherein the pair of fingers extend a finger length from the distal arm end and removably engage a loop in a proximal end of the belt, wherein the clasp slides through the opening between an actuated configuration and an unactuated configuration, wherein the pair of arms pivot between a reduced angle in the actuated configuration and an expanded angle in the unactuated configuration, wherein the distal arm ends engage the restriction bar in the actuated configuration and bias the pair of arms towards the reduced angle, wherein the distal arm ends disengage the restriction bar in the unactuated configuration, wherein the joint biases the pair of arms towards the expanded angle, wherein the pair of fingers are located distally from one another in the unactuated configuration, and wherein the pair of fingers are located proximally to one another in the actuated configuration; and a catch connected to the back face of the frame at a location between the first end of the frame and the restriction bar, wherein the joint releasably engages the catch in a locked orientation, and wherein the joint disengages the catch in an unlocked orientation.

13. The buckle of claim 12, wherein the clasp is restricted from sliding through the opening between the actuated configuration and the unactuated configuration in the locked orientation, and wherein the clasp freely slides between the actuated configuration and the unactuated configuration in the unlocked orientation.

14. The buckle of claim 12, wherein the pair of fingers are situated on a first side of the opening and the joint is situated on a second side of the opening, wherein the pair of fingers are more proximate to the opening than the joint in the actuated configuration, wherein the joint is more proximate to the opening than the pair of fingers in the unactuated configuration, wherein the distal arm ends abut the pair of standoffs in the actuated configuration and bias the pair of arms to the reduced angle, and wherein the pair of standoffs are separated from the distal arm ends in the unactuated configuration and the joint biases the pair of arms to the expanded angle.

15. The buckle of claim 14, wherein each of the pair of arms further comprise a notch at the distal arm end, and wherein the pair of standoffs respectively nest within the notches in the actuated configuration.

16. The buckle of claim 12, wherein the standoff length is no greater than half the prong length.

17. A buckle for a belt, comprising:

a frame comprising a front face, a back face, a pair of side edges, a first end, a second end, a prong, and a pair of longitudinal recesses on the back face of the frame, wherein the prong is connected to the back face proximate to the first end and extends a prong length away from the back face, and wherein the prong removably engages a hole in the distal end of the belt;

a restriction bar comprising a pair of standoffs and a center section, wherein the pair of standoffs respectively comprise a proximal standoff end and a distal standoff end separated by a standoff length, wherein the proximal standoff end of a first standoff slidingly engages a first of the longitudinal recesses situated proximate to a first of the side edges, wherein the proximal standoff end of a second standoff slidingly engages a second of the longitudinal recesses situated proximate to a second of the side edges, wherein the center section connects to the respective standoff distal ends and laterally extends between the pair of side edges, and wherein the pair of standoffs and the center section collectively define an opening adjacent to the back face of the frame;

a clasp comprising a joint, a pair of arms, and a pair of fingers, wherein the clasp is situated proximate to the back face of the frame, wherein the pair of arms extend an arm length from a proximal arm end respectively connected to the joint through the opening to a distal arm end respectively connected to the pair of fingers, wherein the pair of fingers extend a finger length from the distal arm end and removably engage a loop in a proximal end of the belt, wherein the restriction bar slides along the pair of longitudinal recesses between an actuated configuration and an unactuated configuration, wherein the pair of arms pivot between a reduced angle in the actuated configuration and an expanded angle in the unactuated configuration, wherein the restriction bar engages the distal arm ends of the clasp in the actuated configuration and disengages the distal arm ends of the clasp in the unactuated configuration, wherein the joint biases the pair of arms towards the expanded angle, wherein the restriction bar biases the pair of arms towards the reduced angle in the actuated configuration, wherein the pair of fingers are located distally from one another in the unactuated configuration, and wherein the pair of fingers are located proximally to one another in the actuated configuration; and a catch connected to the back face of the frame at a location between the first end of the frame and the restriction bar, and wherein the joint engages the catch.

18. The buckle of claim 17, wherein the pair of longitudinal recesses respectively comprise a recess length between a locked end proximate to the second end of the frame and an unlocked end proximate to the prong, wherein the restriction bar is situated proximate to the locked end in the actuated configuration, wherein the restriction bar is slid away from the locked end towards the unlocked end in the unactuated configuration.

19. The buckle of claim 17, wherein the catch is comprised of a bracket protruding a bracket length from the back face of the frame, wherein the bracket is spaced a distance from the prong towards the second end of the frame, wherein the bracket length is no greater than the standoff length, wherein the distance is less than twice the prong length, and wherein the joint fixedly engages the bracket.

20. The buckle of claim 17, wherein the standoff length is no greater than half the prong length.

* * * * *